US009066600B1

(12) United States Patent
Ramrattan

(10) Patent No.: US 9,066,600 B1
(45) Date of Patent: Jun. 30, 2015

(54) MOSQUITO NETTING SYSTEM AND ASSOCIATED USE THEREOF

(71) Applicant: Rabbideo Ramrattan, Jamaica, NY (US)

(72) Inventor: Rabbideo Ramrattan, Jamaica, NY (US)

( * ) Notice: Subject to any disclaimer, the term of this patent is extended or adjusted under 35 U.S.C. 154(b) by 0 days.

(21) Appl. No.: 14/046,397

(22) Filed: Oct. 4, 2013

Related U.S. Application Data

(60) Provisional application No. 61/709,541, filed on Oct. 4, 2012.

(51) Int. Cl.
*A47C 29/00* (2006.01)

(52) U.S. Cl.
CPC ..... *A47C 29/003* (2013.01); *A47C 29/006* (2013.01)

(58) Field of Classification Search
CPC ..... A47C 29/00; A47C 29/003; A47C 29/006
USPC ..... 135/17, 87; 5/414
See application file for complete search history.

(56) References Cited

U.S. PATENT DOCUMENTS

| | | | | |
|---|---|---|---|---|
| 2,841,803 | A * | 7/1958 | Bodling | 5/113 |
| 4,519,410 | A * | 5/1985 | Kubacki | 135/93 |
| 4,641,387 | A * | 2/1987 | Bondy et al. | 5/658 |
| 5,240,021 | A * | 8/1993 | Snodgrass | 135/96 |
| 6,851,136 | B2 * | 2/2005 | Brereton | 5/102 |
| 7,430,770 | B2 * | 10/2008 | Ramirez | 5/424 |
| 8,061,377 | B2 * | 11/2011 | Vestergaard Frandsen | 135/115 |

FOREIGN PATENT DOCUMENTS

| | | | | |
|---|---|---|---|---|
| GB | 2328225 | A * | 2/1999 | E04H 15/20 |
| GB | 2406786 | B * | 10/2005 | |
| GB | 2480710 | A * | 11/2011 | |
| WO | WO 2009101293 | A2 * | 8/2009 | |

* cited by examiner

*Primary Examiner* — Noah Chandler Hawk

(57) ABSTRACT

A mosquito netting system for preventing the spread of mosquito-borne diseases caused by mosquito bites includes a barrier including a plurality of netting layers and a plurality of plastic layers attached to the netting layers, respectively. The system further includes a platform seated inside the barrier and surrounded by the netting layers as well as the plastic layers, and a bed housed within the barrier and supported by the platform. Notably, the netting layers are spaced above and below a horizontal plane of the bed while plastic layers are oriented about the horizontal plane of the bed thereby preventing undesirable displacement of the barrier away from an outer perimeter of the bed.

7 Claims, 2 Drawing Sheets

MOSQUITO NETTING SYSTEM AND ASSOCIATED USE THEREOF

CROSS REFERENCE TO RELATED APPLICATIONS

Figure 1:
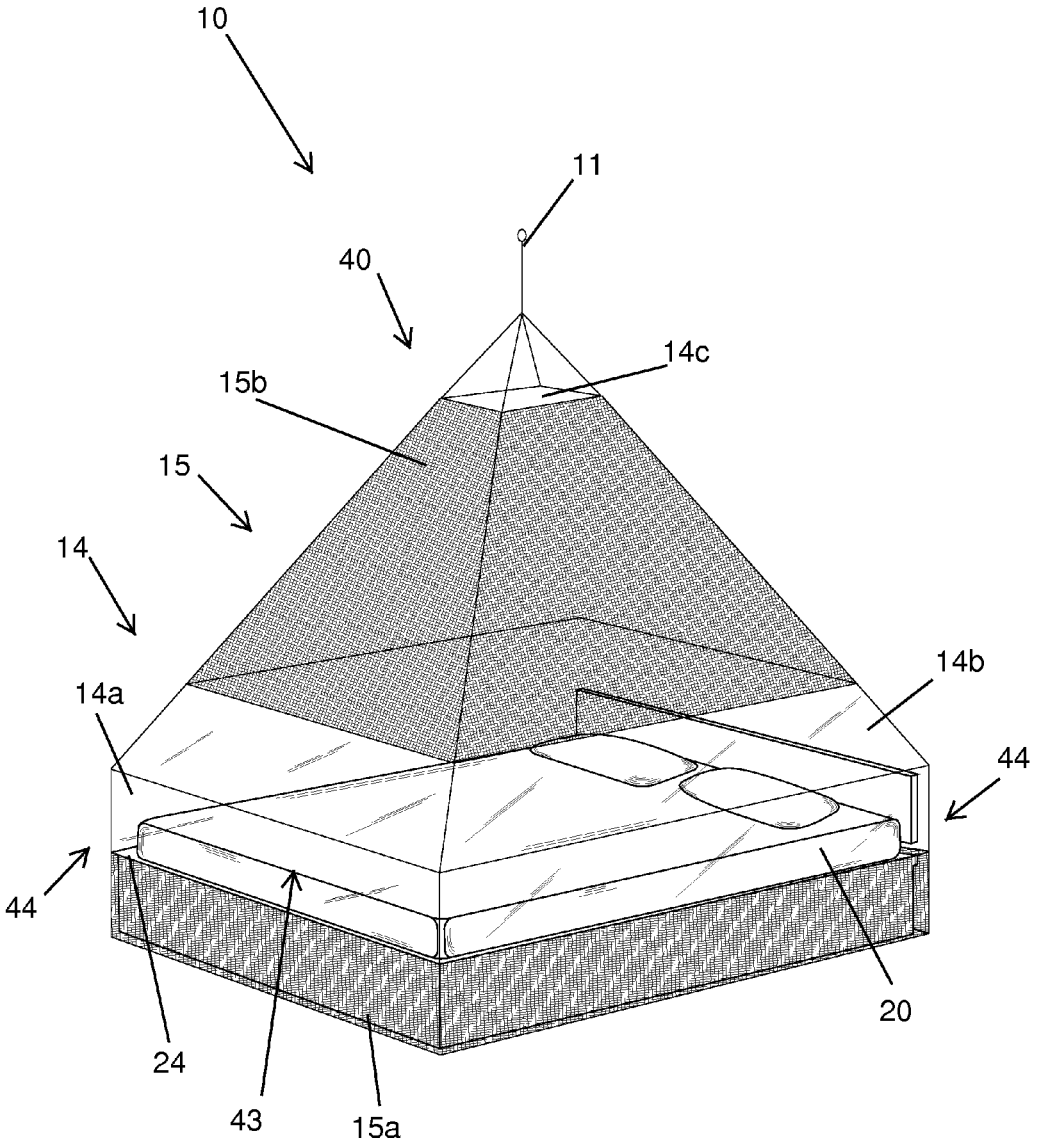

This application claims the benefit of U.S. Provisional Application No. 61/709,541 filed Oct. 4, 2012, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to mosquito netting systems and, more particularly, to an improved mosquito netting system surrounding one's bed for use to provide an effective means of preventing mosquito bites from occurring during the evening hours, when one is sleeping.

2. Prior Art

Millions of consumers around the world are concerned with the detrimental effects of mosquitoes. In fact, according to the American Mosquito Control Association, over one million people die each year from mosquito-borne diseases including Malaria, Dengue Fever, Yellow Fever, Encephalitis and West Nile Virus, to name a few. Not limited to humans, mosquitoes can also prove deadly to animals, spreading Heart Worm, West Nile Virus and even Equine Encephalitis to dogs, horses and the other domesticated animals. Besides the deadly diseases that these insects transmit, being bitten by a non-infected mosquito can nonetheless be an unpleasant experience. Causing the skin to swell and itch, a mosquito bite can also cause severe allergic reactions in many people.

For those who live in areas where there is a high concentration of mosquitoes, the installation of simple mosquito netting can provide an effective barrier between humans and these deadly pests. Specifically, mosquito netting is often installed over beds as a means of preventing mosquito bites that can occur during the night when mosquitoes are most active and unsuspecting victims are fast asleep. Mosquito netting is typically comprised of an ultra-fine, see-through mesh material that prevents insects from biting humans. Typically, these nets are treated with an insecticide solution that serves to further enhance their use. Unfortunately, while mosquito nets are indeed an invaluable resource in preventing the spread of mosquito-borne diseases, there are occasions when a mosquito net can prove ineffective. Specifically, should one roll over while sleeping and abut directly against the mosquito netting, the mosquitoes can actually access the sleeping individual, piercing through the netting and biting the unsuspecting sleeper. As can be imagined, it only takes one bite from a mosquito infected with Malaria, Yellow Fever or similar virus to spread the deadly disease.

Accordingly, a need remains for an improved mosquito netting system in order to overcome prior art shortcomings. The exemplary embodiment(s) satisfy such a need by providing a barrier to use to surround one's bed that is convenient and easy to use, lightweight yet durable in design, versatile in its applications, and designed for preventing mosquito bites that could occur during night hours while one is sleeping and thereby preventing mosquito-borne disease from being transmitted

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a mosquito netting system for preventing the spread of mosquito-borne diseases caused by mosquito bites. These and other objects, features, and advantages of the non-limiting exemplary embodiment(s) are provided by a mosquito netting system including a barrier including a plurality of netting layers and a plurality of plastic layers attached to the netting layers, respectively. The system further includes a platform seated inside the barrier and surrounded by the netting layers as well as the plastic layers, and a bed housed within the barrier and supported by the platform. Notably, the netting layers are spaced above and below a horizontal plane of the bed while plastic layers are oriented about the horizontal plane of the bed thereby preventing undesirable displacement of the barrier away from an outer perimeter of the bed.

In a non-limiting exemplary embodiment, the netting layers and the plastic layers are coupled together in an alternating pattern thereby maintaining a continuous horizontal line of sight along the horizontal plane of the bed while obstructing lines of sight above and below the horizontal plane of the bed, respectively.

In a non-limiting exemplary embodiment, the netting layers are opaque.

In a non-limiting exemplary embodiment, the netting layers are transparent.

In a non-limiting exemplary embodiment, the barrier includes a lower section including a first one of the netting layers and a first one of the plastic layers continuously traveling together along an entire bottom perimeter of the barrier.

In a non-limiting exemplary embodiment, the first netting layer is coupled to the platform and extends downwardly therefrom, and the first plastic layer is coupled to the platform and extends upwardly therefrom beyond the horizontal plane of the bed. In this manner, the first netting layer and the first plastic layer are vertically aligned along a plurality of vertical planes contiguously disposed along to an entire perimeter of the bed.

In a non-limiting exemplary embodiment, the barrier further includes an upper section including a second one of the netting layers and a second one of the plastic layers configured obliquely to the vertical planes and converging upwardly away from the lower section.

In a non-limiting exemplary embodiment, the second plastic layer is connected to the first plastic layer and extends upwardly away therefrom, while the second netting layer being connected to the second plastic layer and extending upwardly away therefrom.

In a non-limiting exemplary embodiment, the first and second plastic layers completely surround the horizontal plane of the bed and are intercalated between the first and second netting layers.

The present disclosure further includes a method for utilizing a mosquito netting system for preventing the spread of mosquito-borne diseases caused by mosquito bites. Such a method includes the steps of: providing a barrier including a plurality of netting layers and a plurality of plastic layers attached to the netting layers, respectively; providing and seating a platform inside the barrier; surrounding the netting layers and the plastic layers around the platform; providing and housing a bed within the barrier such that the platform supports the bed; spacing the netting layers above and below a horizontal plane of the bed; and preventing undesirable displacement of the barrier away from an outer perimeter of the bed by orienting the plastic layers about the horizontal plane of the bed.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

Figure 2:
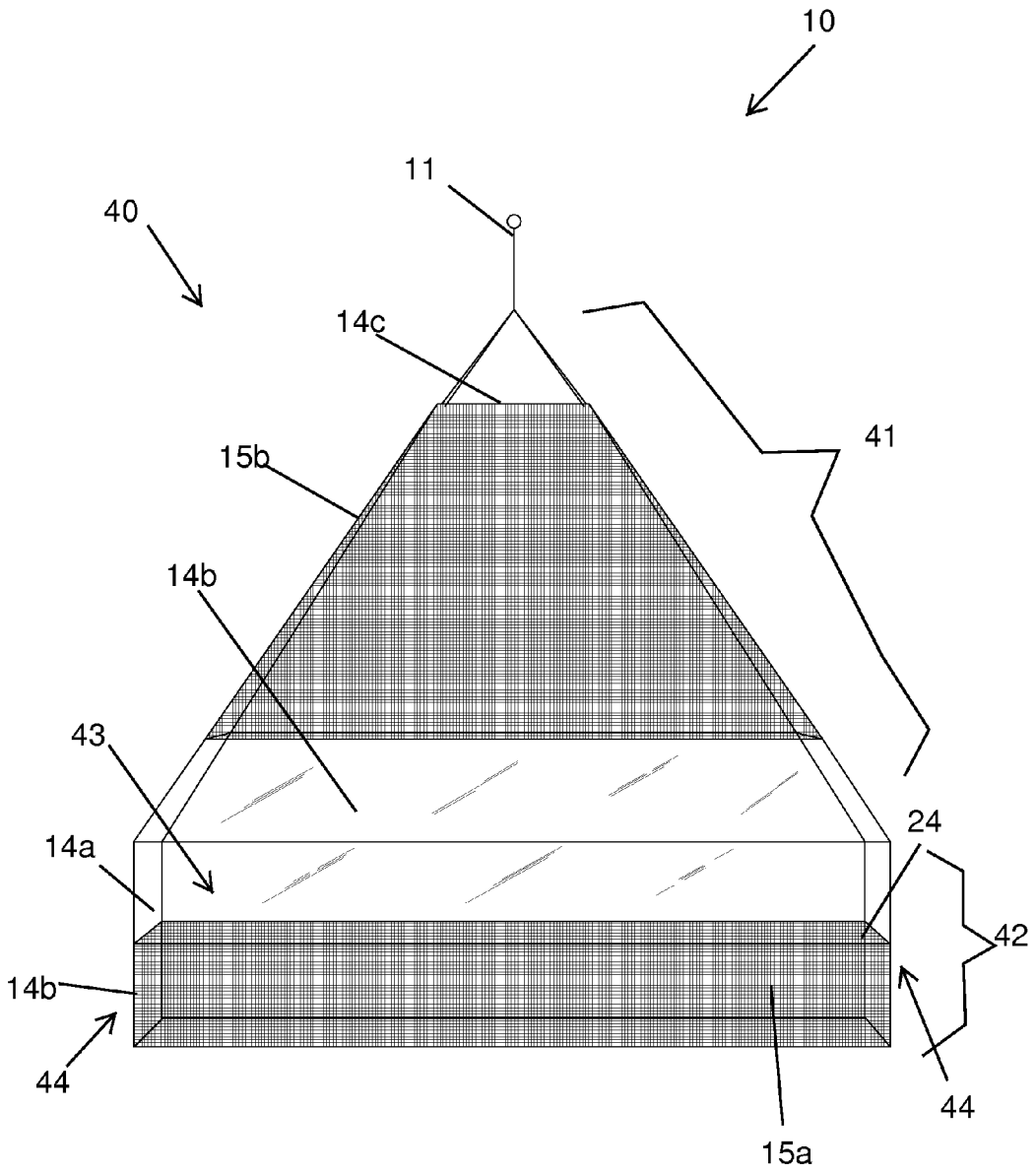

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 1 is a perspective view showing an improved mosquito netting system having a bed situated therein, in accordance with a non-limiting exemplary embodiment; and FIG. 2 is a side elevational view of the mosquito netting system shown in FIG. 1, wherein the bed is removed from an interior thereof.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary emboidment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

A non-limiting exemplary embodiment of the present disclosure is referred to generally in FIGS. 1-2 and is intended to provide an improved mosquito netting system 10 for use in preventing mosquito bites that can occur while sleeping in bed 20. It should be understood that the exemplary embodiment may be used to prevent mosquito bites in many different locations, and should not be limited to any particular bed type described herein.

Referring to FIGS. 1-2 in general, a mosquito netting system 10 includes a barrier 40 including a plurality of netting layers 15 and a plurality of plastic layers 14 attached to the netting layers 15, respectively. The system 10 further includes a platform 24 seated inside the barrier 40 and surrounded by the netting layers 15 as well as the plastic layers 14. A bed 20 is housed within the barrier 40 and supported by the platform 24. Notably, the netting layers 15 are spaced above and below a horizontal plane 43 of the bed 20 while plastic layers 14 are oriented about the horizontal plane 43 of the bed 20 thereby preventing undesirable displacement of the barrier 40 away from an outer perimeter of the bed 20.

In a non-limiting exemplary embodiment, the netting layers 15 and the plastic layers 14 are coupled together in an alternating pattern thereby maintaining a continuous horizontal line of sight along the horizontal plane 43 of the bed 20 while obstructing lines of sight above and below the horizontal plane 43 of the bed 20, respectively.

In a non-limiting exemplary embodiment, the netting layers 15 are opaque.

In a non-limiting exemplary embodiment, the netting layers 15 are transparent.

In a non-limiting exemplary embodiment, the barrier 40 includes a lower section 42 including a first one 15*a* of the netting layers 15 and a first one 14*a* of the plastic layers 14, each 14*a*, 15*a* continuously traveling together along an entire bottom perimeter of the barrier 40.

In a non-limiting exemplary embodiment, the first netting layer 15*a* is coupled to the platform 24 and extends downwardly therefrom. The first plastic layer 14*a* is coupled to the platform 24 and extends upwardly therefrom beyond the horizontal plane 43 of the bed 20. Advantageously, the first netting layer 15*a* and the first plastic layer 14*a* are vertically aligned along a plurality of vertical planes 44 contiguously disposed along to an entire perimeter of the bed 20. Such vertical planes are defined along a height of lower section 44 of barrier 40.

In a non-limiting exemplary embodiment, the barrier 40 further includes an upper section 41 including a second one 15*b* of the netting layers 15 and a second one 14*b* of the plastic layers 14 configured obliquely to the vertical planes 44 and converging upwardly away from the lower section 42. An apex of the barrier 40 is formed by a third one 14*c* of the plastic layers 14.

In a non-limiting exemplary embodiment, the second plastic layer 14*b* is connected to the first plastic layer 14*a* and extends upwardly away therefrom. The second netting layer 15*b* is connected to the second plastic layer 14*b* and extends upwardly away therefrom.

In a non-limiting exemplary embodiment, the first and second plastic layers 14*a*, 14*b* completely surround the horizontal plane 43 of the bed 20 and are intercalated between the first and second netting layers 15*a*, 15*b*.

The present disclosure further includes a method for utilizing a mosquito netting system 10 for preventing the spread of mosquito-borne diseases caused by mosquito bites. Such a method includes the steps of: providing a barrier 40 including a plurality of netting layers 15 and a plurality of plastic layers 14 attached to the netting layers 15, respectively; providing and seating a platform 24 inside the barrier 40; surrounding the netting layers 15 and the plastic layers 14 around the platform 24; providing and housing a bed 20 within the barrier 40 such that the platform 24 supports the bed 20; spacing the netting layers 15 above and below a horizontal plane 43 of the bed 20; and preventing undesirable displacement of the barrier 40 away from an outer perimeter of the bed 20 by orienting the plastic layers 14 about the horizontal plane 43 of the bed 20.

The improved mosquito netting system 10 is comprised of a wide, impenetrable plastic barrier 40 that runs the perimeter of the case of the netting. It can be used in areas where mosquito-borne illnesses are heavily prevalent. The configurations of the netting can vary to suit different needs, which can include, a conical netting supported by way of a hoop-style support brace mounted to the ceiling, a box-like canopy netting that is secured to a rectangular framework mount to the bed 20 frame, and a tent-like style bed 20 netting that rests over the bed 20. The netting itself is offered in one standard size or could be offered in a variety of sizes to accommodate, infant cribs, toddler bed 20*s*, and bed 20*s* used by adults and they can be manufactured with or without an insecticide coating that would further deter mosquito infestations. Tightly woven polyester or comparable material can be used to manufacture the netting with the netting itself sheer, to enable the user to easily view their surroundings.

In a non-limiting exemplary embodiment, the mosquito netting system 10 incorporates an impenetrable plastic barrier 40 about the perimeter of the base of the net, thus preventing mosquitoes from piercing through the net in the event the user rolls against the net in their sleep. The mosquito netting system 10 could be offered in a variety of configurations to suit different needs. Considerations for this netting could include: conical netting supported by way of a hoop-style support brace mounted to the ceiling; box-like canopy netting that is secured to a rectangular framework mounted to the bed 20 frame; and tent-style bed 20 netting that rests over the bed 20, to name a few options. The mosquito netting system 10 could be manufactured of tightly woven polyester or comparable material, with the netting itself sheer to enable the user to easily view their surroundings through the netting. The mosquito netting system 10 could be offered in a one-size standard, or could be offered in a variety of sizes to accommodate infant cribs, toddler bed 20*s* and bed 20*s* used by adults. Further, these nets could be manufactured with or without an insecticide coating that would further deter mosquito infestations.

In a non-limiting exemplary embodiment, an exemplary beneficial aspect is the reinforced barrier 40 that expands the perimeter of the base of the net. Measuring an ample 24 to 30 inches in total height, this banding would be manufactured of lightweight, yet heavy duty plastic material, such as that utilized in the manufacture of shower curtains. The plastic which comprises this barrier 40 would run the entire perimeter of the netting, thus forming an enclosed retaining wall that runs about the perimeter of the user's bed 20. With the mosquito netting system 10 installed in the same manner as traditional netting, the majority of this barrier 40 would be configured to extend above the top of the user's mattress, surrounding the mattress completely. In this manner, should the user toss and turn in their sleep and inadvertently roll into the netting, their body would be abutted against the impenetrable plastic wall, as opposed to the sheer netting itself, with this reliable barrier 40 thus preventing mosquitoes from piercing through the netting and biting the unsuspecting sleeper.

The mosquito netting system 10 offers a number of significant benefits and advantages. For example, the mosquito netting system 10 provides an effective means of preventing mosquito bites from occurring during the evening hours, when one is sleeping. A practical enhancement to the design of mosquito nets which incorporates an ample, plastic barrier 40 wall into its design, the mosquito netting system 10 would offer reliable protection against deadly mosquitoes. Consumers should appreciate that the plastic barrier 40 that runs the perimeter of the unit would be designed so the majority of the barrier 40 was positioned above the top of the mattress. As such, even those who toss and turn in their sleep and often find themselves abutted against their mosquito netting could rest assured that mosquitoes could not pierce through this barrier 40 and render painful and itchy mosquito bites. By preventing mosquito bites from occurring, the mosquito netting system 10 would effectively prevent the painful skin irritation, rashes and other allergic reactions that can result. Furthermore, by preventing mosquitoes from accessing sleeping individuals through the mosquito netting, the mosquito netting system 10 would vastly reduce the spread of deadly mosquito-borne diseases such as Malaria, Encephalitis, Yellow Fever, Dengue Fever and West Nile Virus. In this manner, the mosquito netting system 10 is a practical safety tool that could effectively save lives.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A mosquito netting system for preventing the spread of mosquito-borne diseases caused by mosquito bites, said mosquito netting system comprising:

a barrier including a plurality of netting layers and a plurality of plastic layers attached to said netting layers, respectively;

a platform seated inside said barrier and surrounded by said netting layers as well as said plastic layers; and a bed housed within said barrier and supported by said platform;

wherein said netting layers are spaced above and below a horizontal plane of said bed;

wherein said plastic layers are oriented about said horizontal plane of said bed and thereby prevent undesirable displacement of said barrier away from an outer perimeter of said bed;

wherein said barrier comprise a lower section including a first one of said netting layers and a first one of said transparent plastic layers continuously traveling together along an entire bottom perimeter of said barrier;

wherein said first one of said netting layers comprises a first netting layer first side, a first netting layer second side, a first netting layer third side and a first netting layer fourth side configured to form a first substantially square shape;

wherein said first one of said transparent plastic layers comprises a first transparent plastic layer first side, a first transparent plastic layer second side, a first transparent plastic layer third side, and a first transparent plastic layer fourth side configured to form a second substantially square shape, wherein said first substantially square shape is coextensive with said second substantially square shape;

wherein said barrier further comprises an upper section including a second one of said netting layers and a second one of said plastic layers configured obliquely to said vertical planes and converging upwardly away from said lower section;

wherein said second one of said netting layers comprises a second netting layer first side, a second netting layer second side, a second netting layer third side, and a second netting layer fourth side each having both a second netting layer bottom edge and a second netting layer top edge registered parallel to said horizontal plane, said second netting layer bottom edge and said second netting layer top edge each being spaced above said horizontal plane;

wherein said second one of said plastic layers comprises a second plastic layer first side, a second plastic layer second side, a second plastic layer third side, and a second plastic layer fourth side each having both a second plastic layer bottom edge and a second plastic layer top edge registered parallel to said horizontal plane, said second plastic layer bottom edge and said second plastic layer top edge each being spaced above said horizontal plane and registered parallel to said second netting layer bottom edge and said second netting layer top edge, respectively;

wherein said second plastic layer top edge is contiguously and directly coupled to said second netting layer bottom edge;

wherein said upper section further includes a third one of said plastic layers comprising a third plastic layer first side, a third plastic layer second side, a third plastic layer third side, and a third plastic layer fourth side being contiguously and directly coupled to said second netting layer top edge, wherein said third plastic layer is registered parallel to said horizontal plane.

2. The mosquito netting system of claim 1, wherein said netting layers and said plastic layers are coupled together in an alternating pattern thereby maintaining a continuous horizontal line of sight along said horizontal plane of said bed while obstructing lines of sight above and below said horizontal plane of said bed, respectively.

3. The mosquito netting system of claim 2, wherein said netting layers are opaque.

4. The mosquito netting system of claim 3, wherein said netting layers are transparent.

5. The mosquito netting system of claim 4, wherein said first netting layer is coupled to said platform and extends downwardly therefrom, said first plastic layer is coupled to said platform and extends upwardly therefrom beyond said horizontal plane of said bed, wherein said first netting layer and said first plastic layer are vertically aligned along a plurality of vertical planes contiguously disposed along to an entire perimeter of said bed.

6. The mosquito netting system of claim 5, wherein said second plastic layer is connected to said first plastic layer and extends upwardly away therefrom, said second netting layer being connected to said second plastic layer and extending upwardly away therefrom.

7. The mosquito netting system of claim 6, wherein said first and second plastic layers completely surround said horizontal plane of said bed and are intercalated between said first and second netting layers.

* * * * *